United States Patent [19]

Skatvold, Jr.

[11] Patent Number: 5,003,315

[45] Date of Patent: Mar. 26, 1991

[54] PROGRESSIVE PHASE-ROTMAN-TURNER LENS FEED TRANSMISSION LINE NETWORK

[75] Inventor: Arthur R. Skatvold, Jr., Ridgecrest, Calif.

[73] Assignee: The United States of America as represented by the Secretary of the Navy, Washington, D.C.

[21] Appl. No.: 590,704

[22] Filed: Sep. 27, 1990

[51] Int. Cl.[5] ..... H01Q 3/22; H01Q 3/24; H01Q 3/26

[52] U.S. Cl. ..... 342/373; 343/754

[58] Field of Search ..... 342/373, 375; 343/754; 333/238

[56] References Cited

U.S. PATENT DOCUMENTS

| | | | |
|---|---|---|---|
| 3,192,530 | 6/1965 | Small | 343/854 |
| 3,400,405 | 9/1968 | Patterson, Jr. | 343/854 |
| 3,568,184 | 3/1971 | Drabowitch | 343/5 |
| 3,761,936 | 9/1973 | Archer et al. | 343/754 |
| 3,852,761 | 12/1974 | Bogner | 343/754 |
| 4,298,873 | 11/1981 | Roberts | 343/100 SA |
| 4,532,520 | 7/1985 | Hislop | 343/373 |
| 4,612,548 | 9/1986 | Beltran | 342/373 |
| 4,675,682 | 6/1987 | Adam et al. | 342/375 |

OTHER PUBLICATIONS

W. Rotman et al., "Wide-Angle Microwave Lens for Line Source Appls.", IEEE Trans. on Antennas and Propagation, 1963, vol. AP-11, pp. 623-632.

*Primary Examiner*—Theodore M. Blum

*Attorney, Agent, or Firm*—Harvey A. Gilbert; Melvin J. Sliwka; Sol Sheinbein

[57] ABSTRACT

A progressive phase feed transmission line network for use with a Rotman-Turner lens is composed of a plurality of feed ports for receiving or transmitting energy from or to the lens, a pair of control ports, a plurality of different sets of transmission line segments with the segments in the same sets being of substantially equal lengths, and a plurality of power directors for splitting or combining energy depending upon whether the network is operating in a "receive" or "transmit" mode. Different phase delays are interposed in the network to provide a passive arrangement which can operate in the "receive" mode to determine directionality of energy received by an antenna array and fed through a Rotman-Turner lens to the transmission line network or can operate in the "transmit" mode in combination with adjusting of a phase shifter to directionally steer the energy launched into space by the antenna array after being fed from the network through the lens to the antenna array.

22 Claims, 3 Drawing Sheets

PROGRESSIVE PHASE-ROTMAN-TURNER LENS FEED TRANSMISSION LINE NETWORK

BACKGROUND OF THE INVENTION

1. Field of the Invention

The present invention generally relates to a Rotman-Turner lens phased array antenna system and, more particularly, to a progressive phase feed transmission line network for determining the direction of energy received by or transmitted from the antennas of the system.

2. Description of the Prior Art

A Rotman-Turner lens is an inherently broadband beam former for linear, planar and even conformal microwave phased array antenna systems. The fundamental operation of this lens is described in an article by W. Rotman and R. F. Turner, entitled "Wide-Angle Microwave Lens For Line Source Applications", in *IEEE Transactions On Antennas And Propagation,* 1963, Vol. AP-11, pp. 623–632.

It is desirable to be able to feed energy to output ports of the Rotman-Turner lens so that the antennas attached to input ports of the lens will be phased in such a manner as to steer an antenna array pattern beam in a desired direction in space. It is also desirable to be able to sample or commutate the energy received from the output ports of the Rotman-Turner lens so that the direction of energy impinging on the antenna array and fed to the input ports of the lens can be determined.

One conventional approach to accomplishing these desired objectives is to provide a microwave switching matrix connected to the output ports of the Rotman-Turner lens. However, this approach has several drawbacks. The switching matrix is complex and difficult to lay out and physically requires an inordinate amount of space. Also, when steering or scanning an antenna array beam with amplitude taper for sidelobe level control, commutation of the lens feed ports is complicated even further.

Consequently, there is a need for a different approach to accomplishing the desired objectives with use of the Rotman-Turner lens which will avoid the aforementioned drawbacks of the conventional switching matrix.

SUMMARY OF THE INVENTION

The present invention provides a progressive phase feed transmission line network designed to satisfy the aforementioned need. The approach of the present invention is a passive one contrasted with the active approach of the conventional switching matrix. As a result, it requires much less space and is much less complicated.

Accordingly, the present invention is directed to a progressive phase feed transmission line network operable in a "receive" mode for determining the direction of energy received by an array of antennas and fed through a Rotman-Turner lens to the transmission line network. The feed transmission line is also operable in a "transmit" mode for directional steering of energy launched into space by the antennas after feeding from the transmission line network through the lens to the antennas.

The transmission line network is composed of a plurality of feed ports for receiving or transmitting energy from or to the lens, a pair of control ports, a plurality of different sets of transmission line segments with the segments in the same sets being of substantially equal lengths, and a plurality of power directors for splitting or combining energy depending upon whether the network is operating in the "receive" or "transmit" mode. The network also includes delay elements interposed in the transmission line segments of one of the sets thereof. The delay elements introduce different electrical phase delays in signals transmitted through them. Further, the network includes a phase comparator connected between the control ports which is used in the "receive" mode of the network, and a signal transmitting source connected between the control ports and an adjustable phase shifter interposed in the one control port which are used in the "transmit" mode of the network.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Prior Art System

Figure 1:
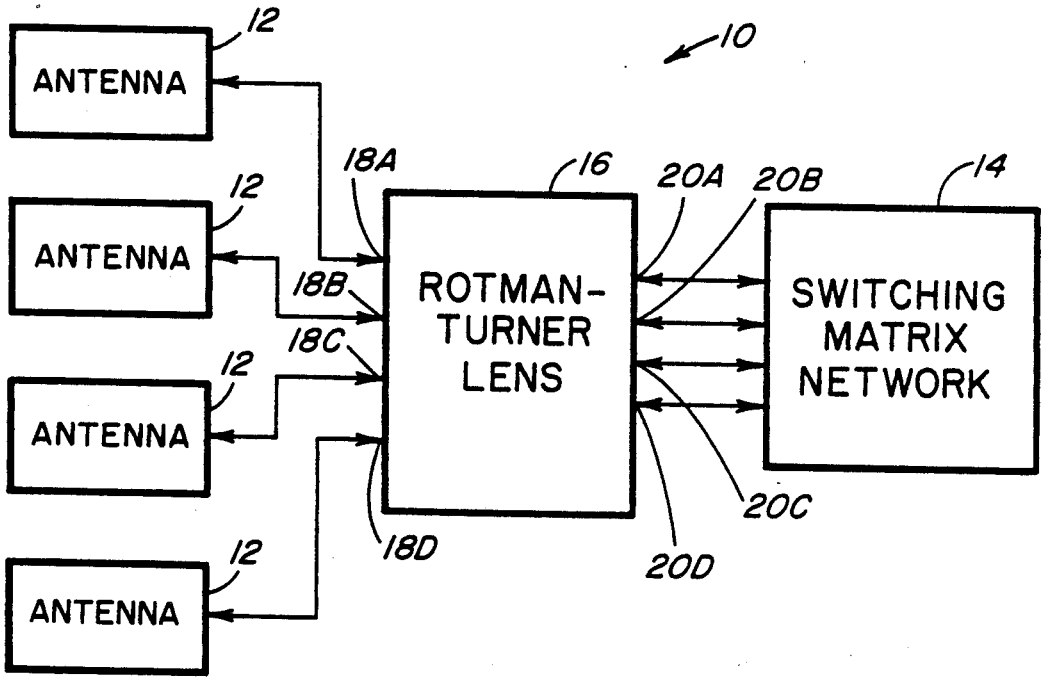
FIG. 1 is a general block diagram of a prior art Rotman-Turner lens phased array antenna system employing a prior art microwave switching matrix network.

Referring now to the drawings, and particularly to FIG. 1, there is illustrated a prior art Rotman-Turner lens phased array antenna system 10. The system 10 basically includes an array of independent antennas 12, a microwave switching matrix network 14, and a Rotman-Turner microwave lens 16 interfacing the antennas 12 with switching matrix network 14.

The antennas 12 are operable for both receiving and launching, or transmitting, a beam or wave front of energy, such as falling in the microwave band. The Rotman-Turner lens 16 has a first plurality of ports 18A, 18B, 18C and 18D and a second plurality of ports 20A, 20B, 20C and 20D. While four ports are illustrated on each opposite side of the lens 16, the actual number could be greater or lesser than four. The antennas 12 are respectively connected to the ports 18A, 18B, 18C, 18D on one side of the Rotman-Turner microwave lens 16, whereas the switching matrix network 14 is connected to the ports 20A, 20B, 20C, 20D on the opposite side of the lens 16.

Each port 20A, 20B, 20C, 20D of the lens 16 represents a different direction from which energy is received by the antennas 12 or in which energy is transmitted by the antennas. If the energy is being received from or transmitted by the antennas 12 in one particular direction, then all of the energy will be fed "in phase" through one of the ports 20A, 20B, 20C, 20D of the lens 16. The particular port would be the one which represents energy from or to that particular direction. The switching matrix network 14 is operated to sample energy from or feed energy to each of the ports 20A, 20B, 20C, 20D to determine the one receiving or transmitting the "in phase" energy.

Transmission Line Network of Present Invention

Figure 2:
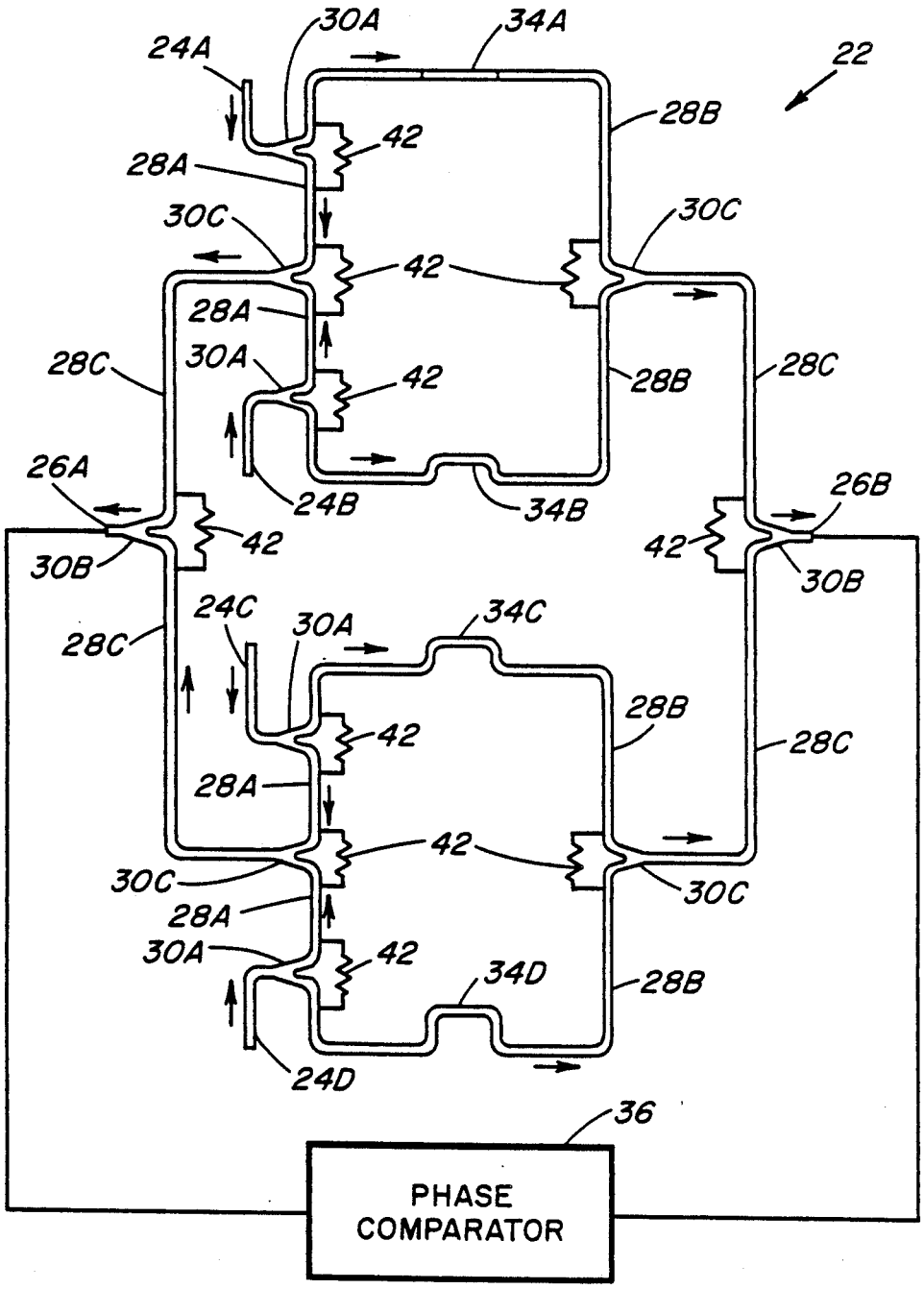
FIG. 2 is a diagrammatic view of a progressive phase feed transmission line network of the present invention being operable in a "receive" mode.
Figure 3:
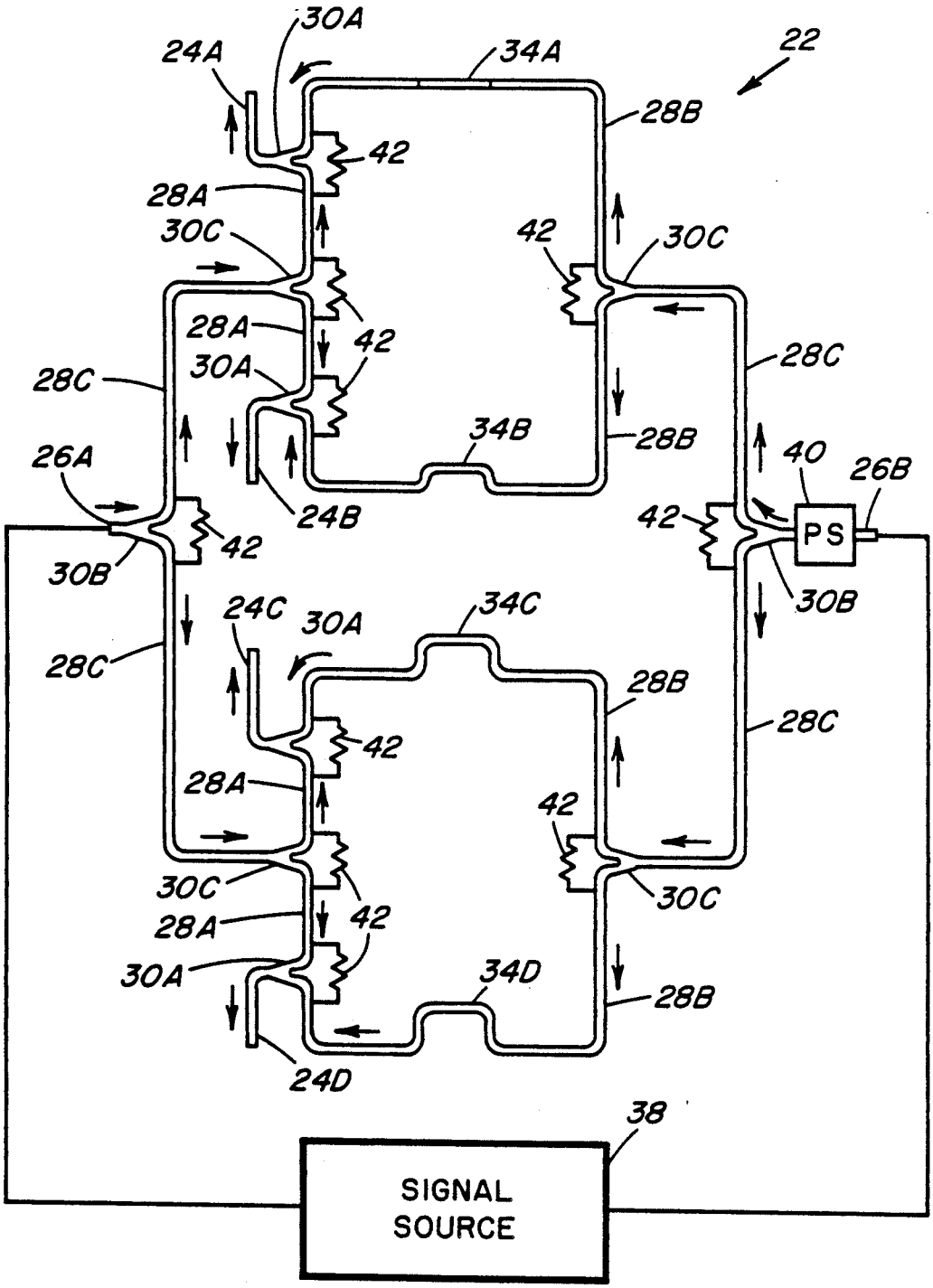
FIG. 3 is a diagrammatic view of the transmission line network of the present invention being operable in a "transmit" mode.

As noted earlier, the prior art switching matrix network 14 is complex and requires too much space. In FIGS. 2 and 3, there is illustrated a progressive phase feed transmission line network of the present invention, generally designated 22, which can be substituted in the Rotman-Turner lens phased array antenna system 10 in place of the prior art switching matrix network 14 for avoiding the drawbacks of the prior art network 14. Basically, the progressive phase feed transmission line network 22 can operate in a "receive" mode, as illustrated in FIG. 2, or a "transmit" mode, as illustrated in FIG. 3. It operates in the "receive" mode, with energy flow in the direction of the arrows in FIG. 2, to determine the direction of energy received by the antennas 12 and fed through the Rotman-Turner lens 16 to the transmission line network 22. In the "transmit" mode with energy flow in the direction of the arrows in FIG. 3, the network 22 operates to directionally steer the energy launched into space by the antennas 12 after being fed from the network 22 through the lens 16 to the antennas.

In its basic components, the transmission line network 22 is composed of a plurality of feed ports 24A, 24B, 24C, 24D, a pair of control ports 26A and 26B, a plurality of first, second and third sets of transmission line segments 28A, 28B, 28C, and a plurality of first, second, and third groups of power directors 30A, 30B, 30C. The term "power director" is being used since the device of these groups 30A, 30B, 30C can either split energy or combine energy depending upon the direction of energy flow through the device. The feed ports 24A, 24B, 24C, 24D of the network 22 are connected respectively to the ports 20A, 20B, 20C, 20D of the lens 16 for receiving energy from or transmitting energy to the lens 16, depending upon whether the network 22 is operating in "receive" or "transmit" mode. The respective transmission line segments in the same ones of the first, second and third sets 28A, 28B, and 28C have substantially equal lengths.

Referring to FIGS. 2 and 3, each of the power directors in the first group 30A interconnect one of the feed ports 24A, 24B, 24C, 24D with a pair of transmission line segments of the first and second sets 28A, 28B. The first group of power directors 30A split or combine energy correspondingly received from or transmitted to the lens 16, depending upon whether the network 22 is operating in "receive" or "transmit" mode.

Certain of the power directors in the third group 30C interconnect the transmission line segments of the third set 28C with pairs of transmission line segments of the first set 28A, while others of the power directors in the third group 30B interconnect the transmission line segments of the third set 28C with pairs of transmission line segments of the second set 28B. The third group of power directors 30C combine or split energy correspondingly received from or transmitted to the lens 16, depending upon whether the network 22 is operating in "receive" or "transmit" mode.

Each of the power directors in the second group 30B interconnect pairs of transmission line segments of the third sets 28C to the respective control ports 26A, 26B. The second group of power directors 30D combine or split energy correspondingly received from or transmitted to the lens 16, depending upon whether the network 22 is operating in "receive" or "transmit" mode.

The network 22 also includes first, second, third and fourth delay elements 34A, 34B, 34C and 34D interposed in the transmission segments of the second set 28B. The delay elements 34A, 34B, 34C, 34D introduce different electrical phase delays on signals transmitted through them, the delay introduced by delay element 34A being the shortest in duration and the delay introduced by delay element 34D being the longest in duration.

Also, as shown in FIG. 2, the network includes a phase comparator 36 connected between the control ports 26A, 26B. Further, as shown in FIG. 3, the network 22 includes a signal transmitting source 38 connected between the control ports 26A, 26B and an adjustable phase shifter 40 interposed in the one control port 26B. Each of the power directors of the groups 30A, 30B, 30C is bridged by an isolation resistor 42.

As mentioned above, the respective transmission line segments in the same ones of the first, second and third sets 28A, 28B, and 28C have substantially equal lengths. Thus, the path lengths from the respective feed ports 24A, 24B, 24C, 24D to the one control port 26A are equal. Likewise, the path lengths from the respective feed ports 24A, 24B, 24C, 24D to the other control port 26B are equal. Given the equal path lengths from the respective feed ports 24A, 24B, 24C, 24D to the one control port 26A and from the respective feed ports to the other control port 26B, the phase difference between the signal outputs at control ports 26A and 26B would be identical for each path if it was not for the presence of the different delay elements 34A, 34B, 34C, 34D in the equal-length paths between feed ports 24A, 24B, 24C, 24D and control port 26B.

Due to the above-described equal path lengths and the presence of the different delay elements 34A, 34B, 34C, 34D in the equal-length paths, when the network 22 is in the "receive" mode as seen in FIG. 2 the direction of the incoming wave front of energy received by the antennas 12 and fed through the Rotman-Turner lens 16 to the transmission line network 22 can be readily determined by the phase comparator 36 connected between the control ports 26A, 26B. Such determination is possible using the phase comparatior 36 since the network 22 is initially calibrated so that it is known in advance which feed port 24A, 24B, 24C, 24D (and thereby which energy wave front direction) corresponds with a given phase difference measured by the phase comparator 36.

Conversely, also due to the above-described equal path lengths and the presence of the different delay elements 34A, 34B, 34C, 34D in the equal-length paths, when the network 22 is in the "transmit" mode as seen in FIG. 3 the direction of an energy wave front transmitted by the antennas 12 can be steered and determined by adjustment of the phase shifter 40. Signals equal in power level and phase are fed from the same signal transmitting source 38 to the control ports 26A and 26B. The energy fed through the network 22 from the two control ports can be made to sum up and be provided "in phase" at a selected one of the feed ports 24A, 24B, 24C, 24D by adjustment of the phase shifter 40 to correspond to the particular one of the delay elements associated with the selected feed port. The energy fed through the network 22 from the two control ports to the non-selected ones of the feed ports will be out of phase. The signal at the control port 26A acts as a reference. The signal phase at control port 26B can be shifted from 0° to 360°.

Since the above-described components of the network 22 are individually conventional and the uniqueness of the present invention resides in the particular combination of components which forms the network 22, it is believe not necessary to illustrate nor describe the individual components in greater detail. To do so would not lead to a clearer and better understanding of the present invention, but instead would tend to burden the disclosure with details which are otherwise readily apparent to those skilled in the art in view of the functional description of the combination of components of the network 22 which has been presented hereinbefore.

The network 22 could be implemented in a constructional form called monolithic microwave integrated circuits. This would allow amplifiers to compensate for power director (divider) and transmission line losses. This would be done using gallium arsenide (GaAs) or gallium aluminum arsenside (GaAlAs) or other types of semi-conductor combinations used in microwave and millimeter wave active device fabrication and power directors (dividers) which could be either narrow or broad band.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely exemplary embodiments thereof.

Having thus described the invention, what is claimed is:

1. A progressive phase feed transmission line network for use with a Rotman-Turner lens and an array of antennas connected to the lens, said network comprising:

a plurality of feed ports for receiving energy from the Rotman-Turner lens;

a pair of control ports;

a plurality of different sets of transmission line segments with the segments in the same sets being of substantially equal lengths and defining paths of equal length extending between and interconnecting said feed ports with said respective pair of control ports;

a first group of power directors interposed in said transmission line segments and communicating with said feed ports for splitting energy routed to said first group of power directors from said feed ports;

a second group of power directors interposed in said transmission line segments and communicating with control ports for combining energy before routed from said second group of power directors to said control ports;

a third group of power directors interposed in said transmission line segments and communicating with said first and second groups of power directors for combining energy routed to said third group of power directors from said first group of power directors and to said second group of power directors;

means for introducing phase delays in said transmission line segments between said feed ports and one of said control ports; and means for measuring the phase difference between energy routed by said transmission line segments from said feed ports to one of said control ports with energy routed by said transmission line segments from said feed ports to the other of said control ports so as to determine which of said feed ports is receiving the greatest level of energy from said lens and thereby the direction of energy received by the array of antennas connected to the lens.

2. The network of claim 1 wherein said feed ports are connected respectively to ports of the lens for receiving energy from the lens.

3. The network of claim 1 wherein each of said power directors in said first group interconnect said feed ports with a pair of transmission line segments of first and second sets for splitting energy correspondingly received from the lens.

4. The network of claim 3 wherein certain of said power directors in said third group interconnect said transmission line segments of a third set with pairs of transmission line segments of said first set and others of said power directors in said third group interconnect said transmission line segments of said third set with pairs of transmission line segments of said second set for combining energy correspondingly received from the lens.

5. The network of claim 4 wherein each of the power directors in said second group interconnect pairs of transmission line segments of said third set with said control ports for combining energy correspondingly received from the lens.

6. The network of claim 5 wherein said means for introducing phase delays are interposed in said transmission line segments of said second set for introducing different phase delays on signals transmitted through them.

7. The network of claim 6 wherein said means for measuring the phase difference between energy routed by said transmission line segments from said feed ports and received at said respective control ports is a phase comparator connected between said control ports.

8. A progressive phase feed transmission line network for use with a Rotman-Turner lens and an array of antennas connected to the lens, said network comprising:

a plurality of feed ports for transmitting energy to the Rotman-Turner lens;

a pair of control ports;

a plurality of different sets of transmission line segments with the segments in the same sets being of substantially equal lengths and defining paths of equal length extending between and interconnecting said feed ports with said respective pair of control ports;

a first group of power directors interposed in said transmission line segments and communicating with said feed ports for combining energy routed to said feed ports from said first group of power directors;

a second group of power directors interposed in said transmission line segments and communicating with control ports for splitting energy routed to said second group of power directors from said control ports;

a third group of power directors interposed in said transmission line segments and communicating with said first and second groups of power directors for splitting energy routed by said third group of power directors from said second group of power directors and to said first group of power directors;

means for introducing phase delays in said transmission line segments between said feed ports and one of said control ports; and means for producing phase shift of the energy transmitted by one of said control ports to one of said power directors of said second group so as to cause combining of energy in phase at and transmission of the energy by a selected one of said feed ports to the lens and thereby determine the direction of energy wave front transmission by the array of antennas connected to the lens.

9. The network of claim 8 wherein said feed ports are connected respectively to ports of the lens for transmitting energy to the lens.

10. The network of claim 8 wherein each of said power directors in said first group interconnect a pair of transmission line segments of first and second sets with said feed ports for combining energy received from said control ports.

11. The network of claim 10 wherein certain of said power directors in said third group interconnect said transmission line segments of a third set with pairs of transmission line segments of said first set and others of said power directors in said third group interconnect said transmission line segments of said third set with pairs of transmission line segments of said second set for splitting energy correspondingly received from said respective control ports.

12. The network of claim 11 wherein each of the power directors in said second group interconnect pairs of transmission line segments of said third set with said control ports for splitting energy correspondingly received from said respective control ports.

13. The network of claim 12 wherein said means for introducing phase delays are interposed in said transmission line segments of said second set for introducing different phase delays on signals transmitted through them.

14. The network of claim 11 wherein said means for producing phase shifts includes:

a signal transmitting source connected between said control ports and transmitting an identical signal to each of said ports; and an adjustable phase shifter interposed in one of said control ports.

15. A progressive phase feed transmission line network for use with a Rotman-Turner lens and an array of antennas connected to the lens, said network comprising:

a plurality of feed ports for receiving or transmitting energy from or to the lens;

a pair of control ports;

a plurality of different sets of transmission line segments with the segments in the same sets being of substantially equal lengths and defining paths of equal length extending between and interconnecting said feed ports with said respective pair of control ports;

a plurality of power directors connected to said different sets of transmission line segments, said feed ports and said control ports for splitting or combining energy depending upon whether the network is respective operating in a "receive" or "transmit" mode; and means for introducing phase delays so as to provide a passive arrangement which can be operated in the "receive" mode to determine the direction of energy received by the antenna array and fed through the Rotman-Turner lens said transmission line segments and therefrom to said control ports or can be operated in the "transmit" mode to steer the transmission of energy into a selected direction into space by the antenna array after being fed from said feed ports through the lens to the antenna array.

16. The network of claim 15 wherein said feed ports are connected respectively to ports of the lens for receiving energy from or transmitting energy to the lens, depending upon whether the network is operating in the "receive" or "transmit" mode.

17. The network of claim 15 wherein each of said power directors in a first group interconnect said feed ports with a pair of transmission line segments of first and second sets for splitting or combining energy correspondingly received from or transmitted to the lens, depending upon whether the network is operating in the "receive" or "transmit" mode.

18. The network of claim 17 wherein each of the power directors in a third group interconnect said transmission line segments of a third set with said control ports for combining or splitting energy correspondingly received from or transmitted to the lens, depending upon whether the network is operating in the "receive" or "transmit" mode.

19. The network of claim 18 wherein certain of said power directors in a second group interconnect pairs of transmission line segments of said first set with transmission line segments of said third set and other of said power directors in said second group interconnect pairs of transmission line segments of said second set with transmission line segments of said third set for combining or splitting energy correspondingly received from or transmitted to the lens, depending upon whether the network is operating in the "receive" or "transmit" mode.

20. The network of claim 19 wherein said means for introducing phase delays are interposed in the transmission segments of the second set for introducing different phase delays on signals transmitted through them.

21. The network of claim 20 further comprising:

a phase comparator connected between said control ports for measuring the phase difference between energy routed by said transmission line segments from said feed ports and received at said respective control ports.

22. The network of claim 21 further comprising:

a signal transmitting source connected between the control ports for transmitting an identical signal to said ports; and an adjustable phase shifter interposed in one of said control ports.

* * * * *